United States Patent [19]

Desjardins

[11] Patent Number: 4,534,139

[45] Date of Patent: Aug. 13, 1985

[54] SANDBLASTER

[76] Inventor: Yvon Desjardins, 897 Lamontagne St., Beellefeuille, Canada, J0R 1A0

[21] Appl. No.: 572,869

[22] Filed: Jan. 23, 1984

[51] Int. Cl.[3] ..... B24D 11/00

[52] U.S. Cl. ..... 51/438; 51/427; 51/436

[58] Field of Search ..... 51/438, 436, 427

[56] References Cited

U.S. PATENT DOCUMENTS

| | | | |
|---|---|---|---|
| 979,897 | 12/1910 | Steedman | 51/436 |
| 2,063,699 | 12/1936 | Schellin | 51/438 |
| 2,210,335 | 8/1940 | Mueller | 51/438 |
| 2,367,647 | 1/1945 | Mott | 51/436 |
| 2,405,854 | 8/1946 | Ruemelin | 51/438 |
| 3,102,368 | 9/1963 | Smith | 51/438 |
| 3,543,444 | 12/1970 | Mehta | 51/427 |
| 3,553,895 | 1/1971 | Power | 51/436 |
| 3,557,498 | 1/1971 | Lindsay . | |
| 3,798,841 | 3/1974 | Eppler | 51/436 |
| 4,080,761 | 3/1978 | Burns | 51/438 |

FOREIGN PATENT DOCUMENTS

| | | | |
|---|---|---|---|
| 8255 | 7/1933 | Australia | 51/438 |
| 351709 | 5/1905 | France | 51/436 |

*Primary Examiner*—Frederick R. Schmidt
*Assistant Examiner*—J. T. Zatarga

[57] ABSTRACT

Sandblasting machine which includes a container for the sand, the bottom end of which is in communication with a sand flow-regulating valve, in turn communicating with a mixing chamber for the compressed air and sand. The outlet of said mixing chamber consists of the inner end of a hose serving to feed the air-sand mixture to the sandblasting nozzle. This inner end of the hose forms a valve seat, which, in conjunction with a ball member, forms a shut-off valve for the sand and air mixture. This shut-off valve is operated by a pneumatic cylinder remotely controlled at the sandblasting nozzle. The inner end of the hose may easily be periodically cut when the abrasive action of the sand wears it out.

2 Claims, 7 Drawing Figures

SANDBLASTER

FIELD OF THE INVENTION

This invention relates to sandblasting machines, more particularly to an improved air-sand mixture flow control device for such machines.

BACKGROUND OF THE INVENTION

Normally use of a sandblaster requires that the flow of abrasive material, such as sand, and compressed air be shut off during operation at times, for example to allow the nozzle operator to change position. Therefore, such machines are provided with air-sand mixture control or shut-off valve means which may be summarized as being relatively complex.

Another equally-important disadvantageous characteristic of sandblasters is that certain internal parts become damaged relatively quickly under the abrasive action of high velocity air-sand mixtures. For example, U.S. Pat. No. 3,557,498, issued to Lindsay, has a sand inlet orifice 51, washer 58 and cushion 57 which can be expected to sustain high wear in a relatively short time, thereby needing frequent replacement and resulting in a loss of work efficiency.

OBJECTS OF THE INVENTION

In view of the above, it is a prime object of the invention to provide a sandblaster having an abrasive-air flow control means which can instantly shut off or open the flow of the abrasive-air mixture and which is of simple construction.

It is another important object of the invention to provide a sandblaster wherein most of the internal elements of the control means are not exposed to the abrasive flow.

It is yet another object of the present invention to provide a sanblaster wherein the control means can be remotely actuated by the blasting nozzle operator.

It is still another object of the invention to provide a sandblaster having a sand-regulating valve and a shut-off valve which can be easily and quickly repaired when they become too worn from abrasion.

SUMMARY OF THE INVENTION

The above and other objects and advantages of the invention are realized according to a preferred embodiment comprising an upright tank or container designed to contain an abrasive grit (usually sand) under pressure, as is known. The lower portion of the tank is preferably funnel-shaped, opening into a sand-feed inlet, the latter being vertically oriented and communicating with an air-sand mixing chamber at its lower end.

Intermediate this lower end and the bottom of the sand tank, the sand-feed inlet has sand-feed regulating valve means. The means determines the air-sand ratio to be used and is usually adjusted to one setting for an entire operation of sandblasting.

The mixing chamber is defined by the lower end of the sand-feed inlet and its intersection with a compressed air inlet. The outlet of the mixing chamber is formed by the inner end of a sandblasting hose inner portion. This inner end of the hose forms a valve seat for a ball member which together define the shut-off valve.

Preferably, a pneumatic cylinder and piston connected to the air source of the sandblaster are provided to move the associated ball member, and this cylinder is remotely actuated at the sandblasting nozzle.

The inner end of the sandblasting hose is preferably bevelled and forms a valve seat for the ball member, which then moves in an inclined path.

Attachment means are provided to removably attach the inner portion of the hose to the mixing chamber.

It will be readily understood that the only parts of the invention subject to abrasive wear are the sand-feed regulating valve and the valve seat-forming end of the inner hose portion. The former is specifically designed for easy replacement of worn parts, as will be described below, while the levelled end can be simply cut when it becomes worn. The sand-air flow control means is not exposed to the sand at all.

BRIEF DESCRIPTION OF THE DRAWINGS

The above will be fully understood by referring to the preferred embodiment of the invention, illustrated by way of the accompanying drawings, in which.

Like numerals refer to like elements throughout the drawings.

DETAILED DESCRIPTION OF THE INVENTION

Figure 1:
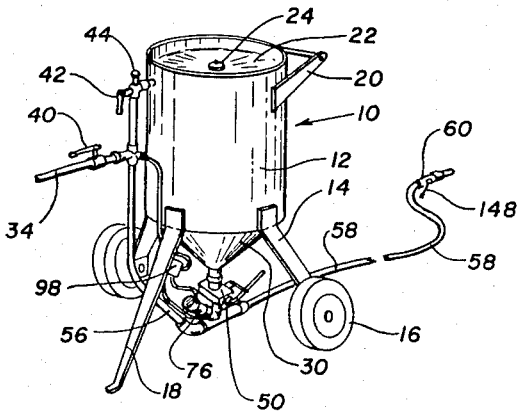
FIG. 1 is a perspective view of a sand-blasting apparatus embodying the invention.

The sandblasting apparatus 10 includes a cylindrical sand container or tank 12 mounted in upright position on legs 14 provided with wheels 16 and on a leg 18 adapted to directly engage the ground. The apparatus can therefore be wheeled about by means of handle 20 fixed to the upper portion of the tank 12. Leg 18 maintains the tank upright when stationary.

Figure 3:
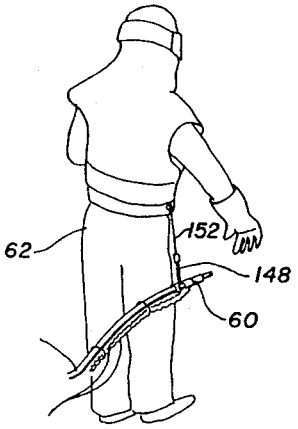
FIG. 3 is a rear perspective view of an apparatus operator, showing the sandblasting hose nozzle tied to the operator's waist by a strap.
Figure 2:
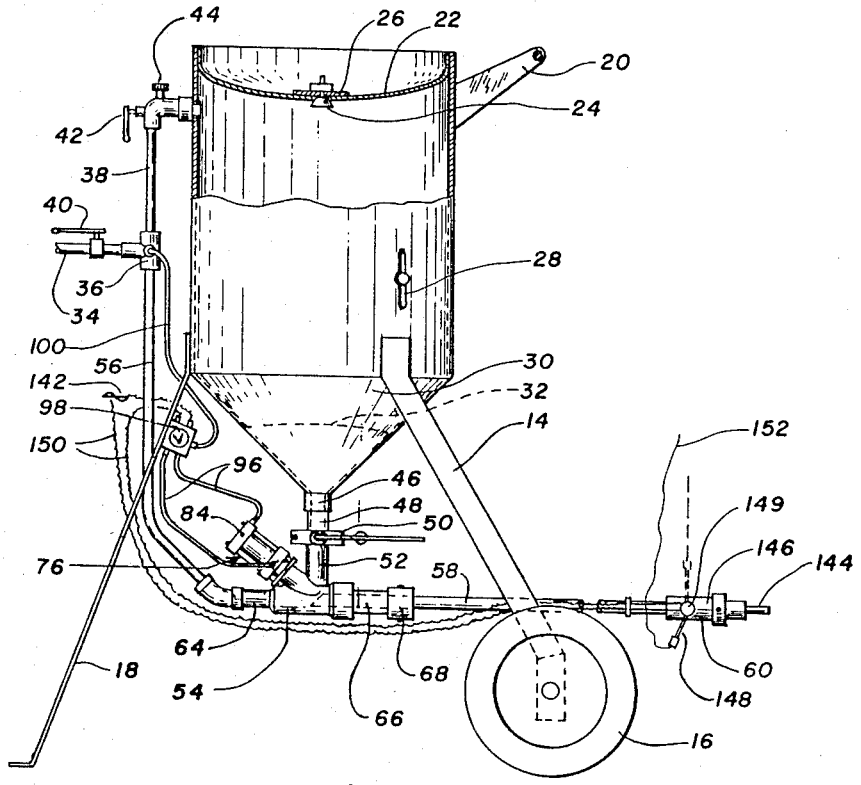
FIG. 2 is a side elevational view of the apparatus, partly sectioned.

As shown in FIG. 2, the top end of the tank is closed by a circular and concave sealing plate 22, which has a central aperture sealingly closable by a check valve 24 carried by washer 26. Check valve 24 permits sand filling of the tank 12 but closes when the latter is air-pressurized. The tank 12 has the usual clean-out 28. The bottom portion of the tank 12 forms a funnel 30 provided with a grating 32 to screen undesirably large sand agglomeration. The tank is adapted to be put under air pressure by means of air supply line 34, T fitting 36 and upper air-line 38, which communicates with the top portion of the tank. Air-lines, or piping 34 and 38, are provided with manually-operated shut-off valves 40, 42, respectively. Top line 38 is also provided with an air-bleeding valve 44, also manually operable to bleed the pressurized tank. The bottom of the funnel 30 is connected by means of a threaded collar 46 to the upper nipple 48 of a sand flow-regulating valve 50, the lower nipple 52 of which forms part of an air and sand mixing chamber 54 through the sand flow-regulating valve 50, while air under pressure is fed to the mixing chamber by air pipe 56 connected to the T fitting 36. A flexible hose 58 is connected to the outlet of the mixing chamber 54 and is terminated by a sandblasting nozzle 60 adapted to be manipulated by the operator, indicated at 62 in FIG. 3.

Figure 4:
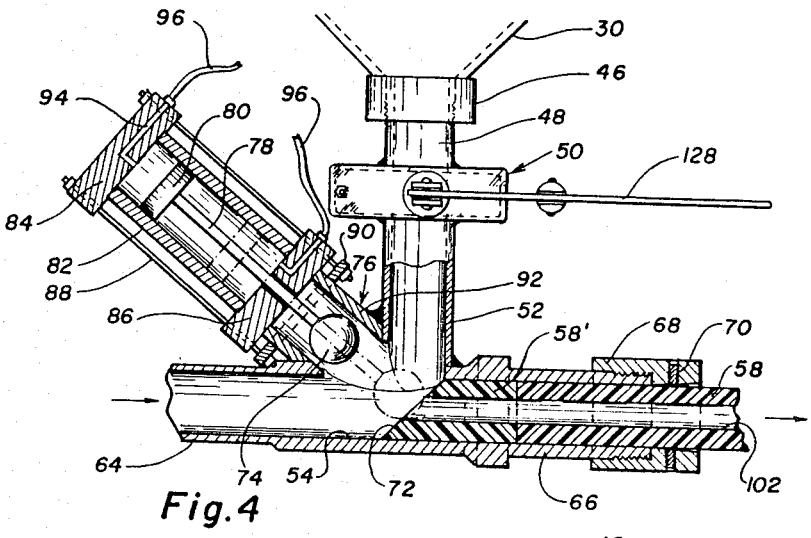
FIG. 4 is an enlarged, cross-sectional view of the bottom portion of the apparatus shown in FIG. 2, showing the air-sand control assembly.
Figure 5:
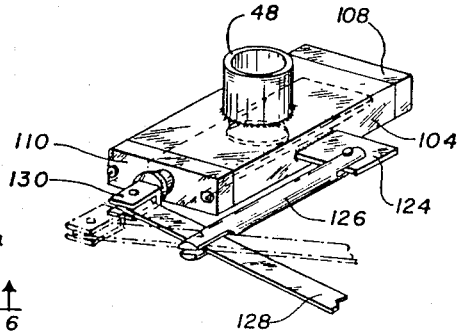
FIG. 5 is a cross-sectional view, taken along line 5—5 of FIG. 6, of the outlet control and a sectional view taken longitudinally of a part of the sand inlet on each said thereof, taken along line 5—5 of FIG. 6.
Figure 7:
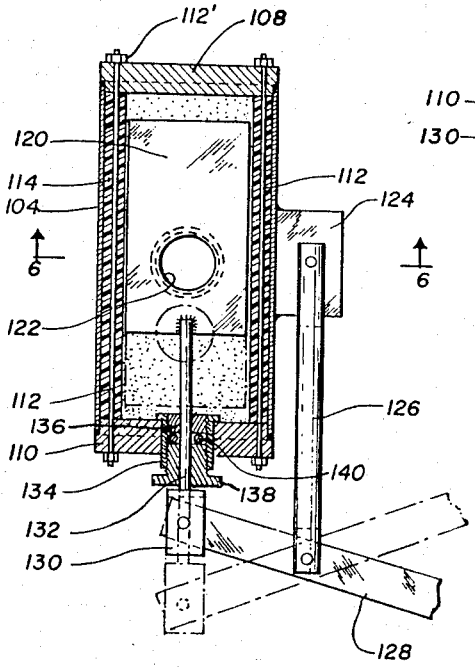
FIG. 7 is a perspective view of the sand-feed regulating means.
Figure 6:
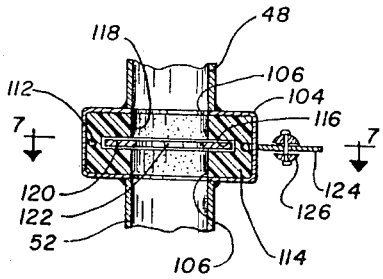
FIG. 6 is another cross-sectional view, taken along line 6—6 of FIG. 5.

As shown in FIG. 4, the mixing chamber 54 is formed by the intersection of the upright lower nipple 52 with a horizontal nipple 64, to the outer end of which is connected the air pipe 56. Nipple 64 forms a co-axial extension 66 protruding from the opposite side of lower nipple 52; said extension receives inner end of the hose 58 which is fixed in position by means of a threaded collar 68 screwed on the extension 66 and also by means of setscrews 70 threaded at angularly-spaced positions around collar 68 and engaging the hose 58. The hose 58 has a separate inner part 58' which has a bevelled inner end 72 making a 45-degree angle with the long axis of the hose and exposed within the mixing chamber 54. This bevelled end 72 forms a valve seat for a ball-shape valve member 74 of a shut-off valve, generally indicated at 76, for the sand and air mixture. The ball member 74 is secured to the outer end of a piston rod 78, the other end of which is fitted with a piston 80, which is movable within a cylinder 82 closed at both ends by end caps 84, 86, the end cap 86 having a central hole for the passage of piston rod 78. The assembly of the cylinder 82 and end caps 84 and 86 is secured together in fluid-tight relation by tie-rods 88, also securing the cylinder assembly to a flange 90 surrounding and fixed to the outer end of a nipple 92 in communication with a mixing chamber 54 and welded, or otherwise fixed, to the lower nipple 52 and the horizontal nipple 64, being in the plane of said two nipples and making a 45-degree angle with respect to each nipple. The end caps 84, 86, are provided with air passages 94 in communication with the interior of the cylinder 82 on both sides of the piston 80 and connected to pressurized air-lines 96, in turn connected to a three-way valve 98 fixed to the apparatus, for instance to leg 18. The three-way valve 98 is fed with air under pressure by a branch air-line 100 connected to the T fitting 36.

As shown in FIG. 4, the ball member 74 moves in a path perpendicular to the bevelled end face 72 of hose 58 and makes sealing contact with the edge of the center bore 102 of the hose 58.

In the open retracted position of the ball member 74, the latter is wholly confined within the nipple 92 and out of the path of the sand and air streams flowing into the mixing chamber at the intersection of nipples 52 and 64.

Therefore, there is very little abrasive action on the ball member 74 in the operation of the sandblasting machine. Only the exposed inner end 72 of the hose is subjected to abrasion. When worn out, hose part 58' is simply replaced. If parts 58, 58' are made of one piece, the inner end of the hose may be very easily detached from the tubular extension 66 and cut again at a 45-degree angle and replaced within the mixing chamber.

Referring now to FIGS. 4 to 7 inclusively, there is shown the sand feed-regulating valve means 50. Valve means 50 includes a rectangular elongated box-shaped casing 104, made of rigid material and provided with central and registering top and bottom openings communicating with the respective sand nipples 48 and 52. Each end of casing 104 is closed by end cap members 108,110 which are detachably secured to casing 104 by a pair of laterally-spaced longitudinal tie-rods 112 and nuts 112'.

The interior of casing 104 is filled with a sealing block 114, preferably made of rubber and formed with a longitudinal slot 116 defining a slide pathway in casing 104. Block 114 further has a transverse through bore 118 in register with casing openings 106.

A flat rectangular slide plate valve 120 is provided, for longitudinal sliding inside casing 104 along the pathway, and formed with a central hole 122. Operating means are also provided to move plate 120, consisting of an outwardly-projecting flange 124 secured to one side of casing 104, a lever 126 pivotally secured to flange 124 and an operating arm 128. The latter is pivotally secured in its middle to the opposite end of lever 126 and also to a clevis 130 fixed to the outer end of a rod 132, which extends through end cap 110 and is secured to an end of slide plate 120. Compressible block makes a sliding and fluid-tight fit with slide plate 120. An inwardly-threaded bushing 134 is fixed through end cap 110 and surrounds rod 132. Plug 136 and 138 are screwed in bushing 134 and their bore has a sliding fit with rod 132. A packing 140 surrounds rod 132 and is compressed by screwing outer plug 138 towards plug 136.

It will be clear that the flow of sand may be metered precisely as desired by moving plate valve 120 such that its hole 122 is in partial or complete registry with the through bore 118, or alternately, in total disregistry to shut the flow of sand. Moreover, the rubber sealing block 114 ensures that the only portion of the assembly exposed to high abrasion be the portion of plate valve 120, immediately adjacent hole 122. Whenever plate valve 120 is sufficiently worn away, it is very simply replaced by disconnecting operating arm 128 and removing end cap 110.

Three-way valve 98 is preferably an electro-valve connected to an electrical power source 142.

Nozzle assembly 60 includes a nozzle 144 and a handle portion 146, the latter being provided with a pivotally-attached control lever 148 which operates a switch 149 electrically series connected with electro-valve 98 by a pair of wires 150 running along hose 58. Lever 148 pivots from a downwardly vertical position to an upwardly vertical position, being provided with a small strap or cord 152 which can be attached to the waist of operator 62 (cf. FIG. 3). It will be clear that in the former position, shut-off valve 76 will be open, permitting the sand-air mixture to reach nozzle 60, while in the latter position, the valve 76 will close to instantly shut off the flow. Thus, when operator 62 releases nozzle handle portion 146, lever 148 will be pulled upwardly by cord 152, thereby constituting a dead-man safety feature.

It is to be noted that, should cleaning of the internal elements of the machine, specifically mixing chamber 54 and the bore of hose 58, become necessary, it is a simple matter to shut sand-regulating valve 50 while leaving ball member 74 open, so that only compressed air will be blasted therethrough.

What I claim is:

1. A sandblasting apparatus comprising an upright container for containing abrasive grit under pressure and having a discharge opening at its bottom, a manually-operable grit flow-regulating valve communicating with said discharge opening, an air and sand mixing chamber including a compressed air inlet nipple, a grit inlet nipple, an outlet nipple and a fourth nipple forming a unitary unit and adapted to be mounted under said upright container with said grit inlet nipple disposed upright and communicating with said grit flow-regulating valve, aid air inlet nipple and outlet nipple axially aligned and making a substantially right angle with said grit inlet nipple, said fourth nipple making an acute angle with said air inlet nipple, all of said nipples intersecting and defining a cavity at their intersection, said air inlet nipple provided with means for connection to a supply of air under pressure, a sandblasting hose, of elastomeric material, having one end portion inserted into and detachably secured to said outlet nipple and carrying a nozzle at its other end portion, said hose having a bore, the inner end of said hose exposed within said cavity, a double-acting pressurized air-operated cylinder and piston unit removably mounted on, and carried by, the outer end of said fourth nipple, a piston rod fixed to the piston of said unit and axially extending through said fourth nipple, a ball fixed to the outer end of said piston rod and of larger diameter than that of said bore, said ball movable by said cylinder and piston unit between a retracted position confined within said fourth nipple and shielded from grit flowing through said grit inlet nipple, and an advanced position abutting said hose inner end and sealing said bore, and remote control means operable at said nozzle for operating said cylinder and piston unit.

2. A sandblasting apparatus as defined in claim 1, wherein said inner end of said hose exposed within said cavity is formed by a hose portion wholly confined within said outlet nipple and forming a part separate from the remaining portion of said hose and making a joint with said hose remaining portion located within said outlet nipple.

* * * * *